US006787210B2

(12) United States Patent
Stickler

(10) Patent No.: US 6,787,210 B2
(45) **Date of Patent: *Sep. 7, 2004**

(54) ABSORBENT PAD FOR USE WITH URINAL

(76) Inventor: R. Dean Stickler, 1511 SE. 12th Ct., Fort Lauderdale, FL (US) 33316

( * ) Notice: Subject to any disclaimer, the term of this patent is extended or adjusted under 35 U.S.C. 154(b) by 39 days.

This patent is subject to a terminal disclaimer.

(21) Appl. No.: 09/909,472

(22) Filed: Jul. 19, 2001

(65) Prior Publication Data

US 2002/0076570 A1 Jun. 20, 2002

Related U.S. Application Data

(63) Continuation-in-part of application No. 09/119,204, filed on Jul. 20, 1998, now Pat. No. 6,265,084, which is a continuation-in-part of application No. 08/909,554, filed on Aug. 12, 1997, now abandoned.

(51) Int. Cl.[7] ..... B32B 33/00

(52) U.S. Cl. ..... 428/41.7; 4/251.1; 4/251.2; 4/254; 4/256.1; 604/317; 604/318; 604/322; 604/358; 604/359; 604/360; 604/365; 604/366; 604/367; 604/378; 604/384; 604/385.01; 604/386; 428/40.1; 428/42.3; 428/47; 428/51; 428/52; 428/58; 428/77; 428/80; 428/317.1; 428/317.3; 428/332; 428/343; 428/354; 428/542.2; 132/333; 442/59; 442/96; 442/123; 442/125; 442/171; 442/333; 442/396

(58) Field of Search ..... 442/59, 96, 123, 442/125, 171, 333, 394, 396, 399, 414; 428/40.1, 41.7, 42.3, 47, 51, 52, 58, 77, 80, 317.1, 317.3, 332, 343, 354, 542.2, 542.6, 542.8, 543, 905, 907; 4/251.1, 251.2, 254, 256.1; 132/333; 604/317, 318, 322, 358, 359, 360, 365, 366, 367, 378, 384, 355.01, 386

(56) References Cited

U.S. PATENT DOCUMENTS

| | | | |
|---|---|---|---|
| 2,707,352 | A | 5/1955 | Fischer |
| 2,897,108 | A | 7/1959 | Harwood |
| 4,125,656 | A | 11/1978 | Creamer |
| 4,285,075 | A | 8/1981 | Nelson |
| 4,684,562 | A | 8/1987 | Hartkemeyer |
| 4,813,944 | A | 3/1989 | Haney et al. |
| 4,822,669 | A | 4/1989 | Roga |
| 4,938,957 | A | 7/1990 | Iwahashi |
| 5,156,843 | A | 10/1992 | Leong et al. |
| 5,439,458 | A | 8/1995 | Noel et al. |
| 5,506,040 | A | 4/1996 | Cordani |
| 6,265,084 | B1 | 7/2001 | Stickler |

FOREIGN PATENT DOCUMENTS

| | | |
|---|---|---|
| JP | 164094 | 6/2000 |
| WO | WO 9822280 | 5/1998 |

*Primary Examiner*—Arti R. Singh
(74) *Attorney, Agent, or Firm*—Malin, Haley & DiMaggio, P.A.

(57) ABSTRACT

An inexpensive and disposable, highly absorbent pad for placement on a floor surface, directly in front of a urinal, for absorbing fluid not deposited within the confines of the urinal which would otherwise drip on the floor. Fluid absorbed by the pad is prevented from reaching the underlying floor thereby eliminating the problems associated with fluids being deposited on the floor. The pad includes a normally concealed incorporates a normally concealed, flexible, thin plastic disposal container connected to a pad removal member. The disposal container is stored in a normally concealed location, preferably beneath the pad, and automatically deploys and envelops the pad when a force is exerted on the removal member during the pad removal process.

4 Claims, 5 Drawing Sheets

ABSORBENT PAD FOR USE WITH URINAL

This application is a continuation of continuation-in-part patent application Ser. No. 09/119,204 filed Jul. 20, 1998, now U.S. Pat. No. 6,265,084 which is a continuation-in-part of application Ser. No. 08/909,554, filed Aug. 12, 1997 now abandoned.

BACKGROUND OF THE INVENTION

1. Field of the Invention

The present invention relates to rest room accessories, and more particularly to a floor mounted absorbent pad for use with a urinal fixture for absorbing fluids that would otherwise become deposited on the floor.

2. Description of the Background Art

The human urinary system filters waste products from the blood stream and removes them from the body by a filtering process which produces a watery fluid that leaves the kidney as urine (hereinafter "fluid"). Urinal fixtures in rest rooms for facilitating male urination are well known. A typical male urinal comprises a wall mounted receptacle elevated approximately thirty inches above the floor.

There are a number of problems associated with the use of urinals. For example, it is not uncommon for fluid to become accidentally or unintentionally deposited on the outside of the urinal fixture, and on surrounding surfaces such as the floor during urination. It has been found that the floor area directly below the front of urinal is an area most subject to exposure to fluid. The accumulation of fluid on the floor presents an unsightly appearance and may render the area unsanitary. In addition, floors wetted with fluid can become quite slippery thereby presenting a hazardous condition and accident potential, which, if not remedied, may subject the property owner to liability resulting from personal injuries caused by the hazard. As a result, substantial efforts must be dedicated to cleaning and sanitizing the urinal areas, particularly the floor.

U.S. Pat. No. 4,125,656, issued to Creamer, discloses a disposable, absorbent pad adapted to be formed into an adjustable U-shaped configuration and to be placed around the base of a toilet to absorb moisture near the base. The pad may include a water-proof backing and an adhesive that bonds the pad to the floor. The device disclosed by Creamer, however, includes a U-shaped structure intended for use adjacent to the base of a toilet, and is not suitable for use with a wall mounted, urinal. Furthermore, Creamer does not disclose a sanitary method or structure to facilitate removal and/or disposal.

SUMMARY OF THE INVENTION

An inexpensive and disposable, highly absorbent pad for placement on a floor surface, directly in front of a wall mounted urinal, for absorbing fluid not deposited within the confines of the urinal which would otherwise drip on the floor. Fluid absorbed by the pad is prevented from reaching the underlying floor thereby eliminating the problems associated with fluids being deposited on the floor.

The pad is fabricated from a first layer of fluid absorbing material bonded to a second layer of non-slip fluid impervious material. The first layer preferably includes an antibacterial agent and may further include an agent for eliminating odor and/or providing a pleasing fragrance. The pad is preferably shaped in the form of substantially flat, truncated annular sector, resembling a truncated pie-slice, and specifically sized and positioned so as to collect substantially all of the fluid not deposited within the confines of the urinal fixture that would otherwise become deposited onto the floor. The second layer of fluid impervious material prevents fluids from penetrating the pad and reaching the underlying floor, and includes a back surface having non-slip characteristics and/or at least one adhesive strip associated therewith for adhesively securing the pad in place on the floor, and preventing the pad from slipping.

In a preferred embodiment, the pad further incorporates a normally concealed, flexible, thin plastic disposal container connected to a pad removal member. The disposal container is stored in a normally concealed location, preferably beneath the pad, and automatically deploys and envelops the pad when a force is exerted on the removal member during the pad removal process. In the preferred embodiment, the removal member comprises a ring-like structure that is connected by a plurality of cords, or other suitable deployment mechanics, to the opening of the concealed disposal container. Removal of the pad may be facilitated by a removal tool having a suitable tip configuration for engaging and lifting the ring-like removal member, whereby applying a force to the removal member functions to deploy the thin plastic container thereby enveloping the fluid containing pad in a container suitable for disposal. Thus, the pad may be removed from its installed position on the floor and disposed of in a sanitary manner without requiring maintenance personnel to come in direct contact with the fluid laden pad.

Accordingly, it is an object of the present invention to provide a disposable urinal drip pad for use with a wall mounted urinal fixture.

It is another object of the present invention to provide a disposable urinal drip pad capable of being adhesively secured to the floor area immediately in front of a wall mounted urinal fixture.

Yet another object of the present invention is to provide a disposable urinal drip pad which is compact, yet specifically sized and placed for collecting fluid that is not deposited within the confines of a urinal fixture, and thus preventing the accumulation of fluid on the surrounding floor area.

Still another object of the present invention is to provide a disposable urinal drip pad having a readily deployable disposal container associated therewith.

In accordance with these and other objects which will become apparent hereinafter, the instant invention will now be described with particular reference to the accompanying drawings.

DESCRIPTION OF THE PREFERRED EMBODIMENTS

Figure 1:
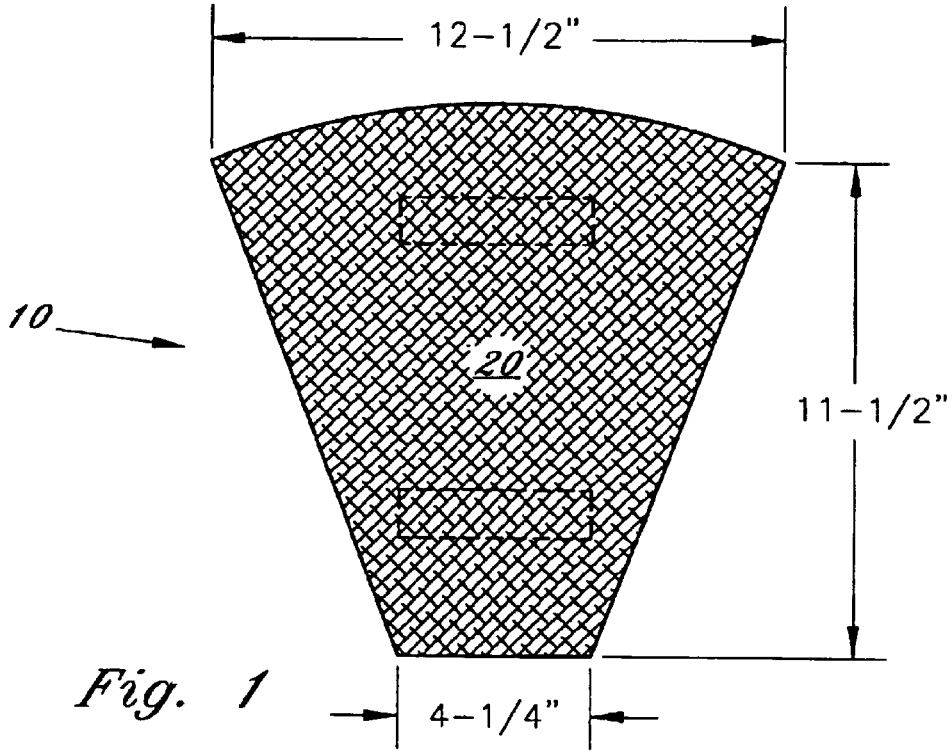
FIG. 1 is a top plan view of a urinal drip pad according to the present invention, including approximate dimensions of a preferred embodiment thereof.
Figure 2:
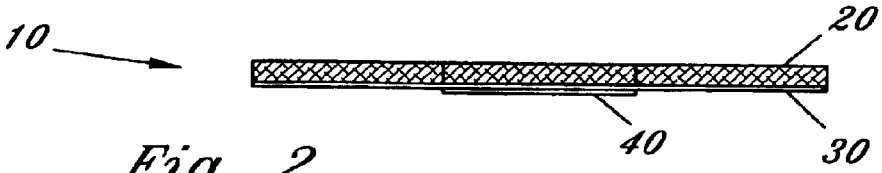
FIG. 2 is a side elevational view of the urinal drip pad depicted in FIG. 1.
Figure 3:
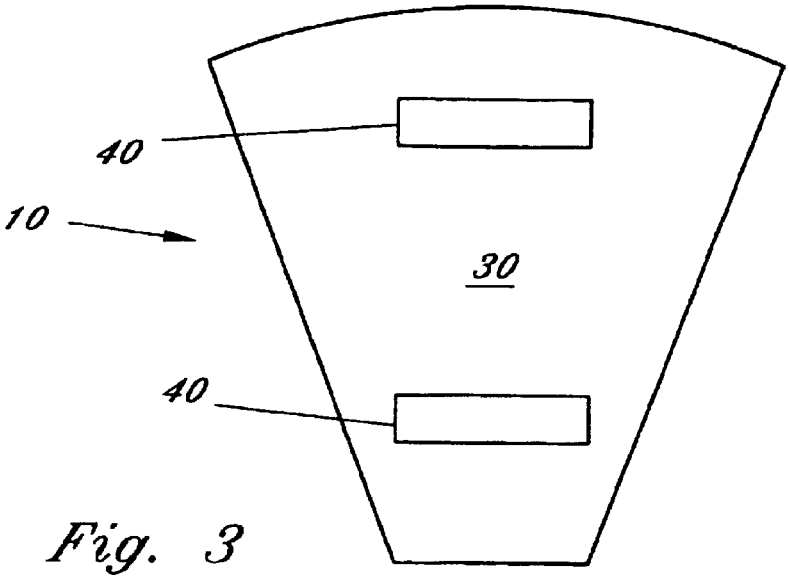
FIG. 3 is a bottom plan view of the urinal drip pad of FIGS. 1 and 2.

FIGS. 1–3 depict an embodiment of the urinal drip pad, generally referenced as 10, of the present invention. Drip pad 10 comprises an inexpensive and disposable, highly absorbent, multi-layered pad for placement on the floor directly in front of a wall mounted urinal fixture, for absorbing fluid, not deposited within the confines of the urinal, which would otherwise drip on the floor. Drip pad 10 is sized and shaped for floor mounting and placement directly beneath and at least partially in front of a wall mounted urinal such that the pad is positioned so as to catch and receive fluid, such as urine and water.

Drip pad 10 comprises a sheet fabricated from a first layer of fluid absorbing material 20 bonded to a second layer of fluid impervious material 30. The first layer of fluid absorbing material 20 comprises non-woven polypropylene material having a density of approximately 8 to 12 ounces per square yard; and, the second layer of fluid impervious material 30 comprises a layer of clear polyester having a thickness of approximately 0.57 mils. An example of a suitable multi-layered material is disclosed in U.S. Pat. No. 5,506,040, which disclosure is incorporated herein by reference. The second layer 30 prevents fluids from penetrating through the pad and reaching the underlying floor, and includes a back surface having adhesive characteristics, such as at least one adhesive strip 40, for adhesively securing the pad to the floor and for preventing the pad from slipping. Adhesive strips 40 comprising double sided tape, are secured to the undersurface of the fluid impervious second layer 30, for anchoring the pad to a floor surface. While this embodiment contemplates that adhesive strips 40 may be secured to the undersurface of layer 30, it is further contemplated that second layer 30 may have inherent adhesive characteristics that provide the non-slip function described herein, or adhesive strips may be indirectly attached to pad 10 by direct attachment to other undersurface components and/or portions of the pad.

Figure 4:
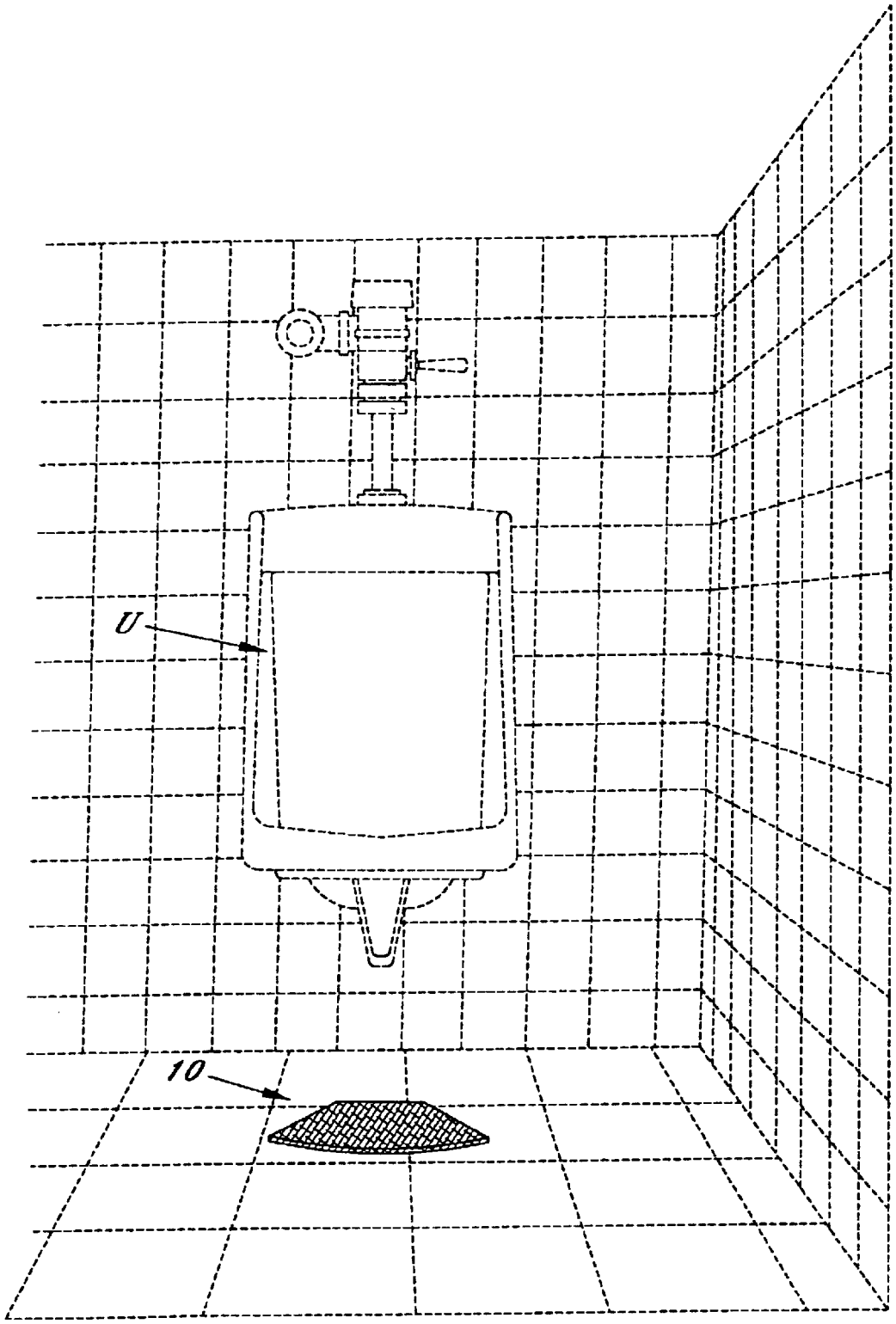
FIG. 4 is a perspective view of the urinal drip pad installed in front of a urinal.

Drip pad 10 is preferably trapezoidally shaped in the form of substantially flat, truncated, annular sector, resembling a truncated pie-slice. The embodiment of drip pad 10 depicted in FIG. 1 has a length of approximately 11½", a first end having a width of approximately 12½", and a second end having a width of approximately 4¼". FIG. 4 depicts drip pad 10 disposed on a floor in relation to a urinal referenced as "U". Pad 10 is thus specifically sized such that when properly positioned it is in place to collect substantially all of the fluid not deposited within the confines of the urinal fixture that would otherwise drip onto the floor directly below, and in front of, the urinal. In addition, the trapezoidal shape functions to maximize the amount of floor area covered while remaining unobtrusively disposed between the feet of a urinal user.

In a preferred embodiment, drip pad 10 further includes a normally concealed, flexible, thin plastic disposal container 50 connected to a pad removal member 60. As best depicted in FIGS. 5*a*–5*e*, the disposal container is stored in a concealed location, preferably beneath the pad, and automatically deploys and envelops the pad when a force is exerted on removal member 60 during the pad removal process. Removal member 60 comprises a ring-like structure, is disposed beneath the pad, and is connected to the opening of the concealed plastic container by a plurality of cords 62.

Figure 5C:
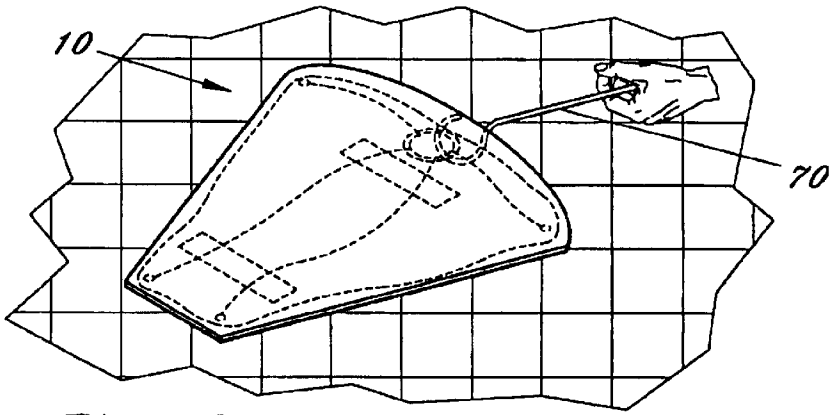
FIG. 5*c* is a top perspective view of the urinal drip pad illustrating step one of the removal and disposal process.
Figure 5E:
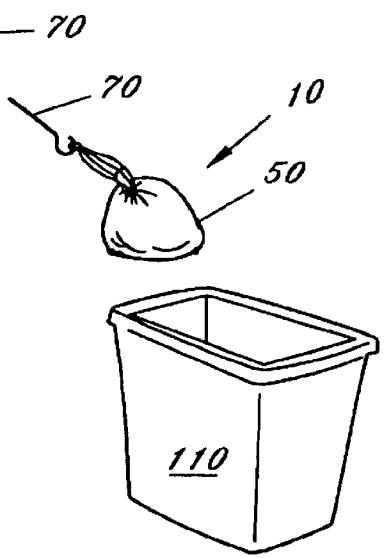
FIG. 5*e* is a perspective view of the urinal drip pad being disposed of within the disposal container.
Figure 5D:
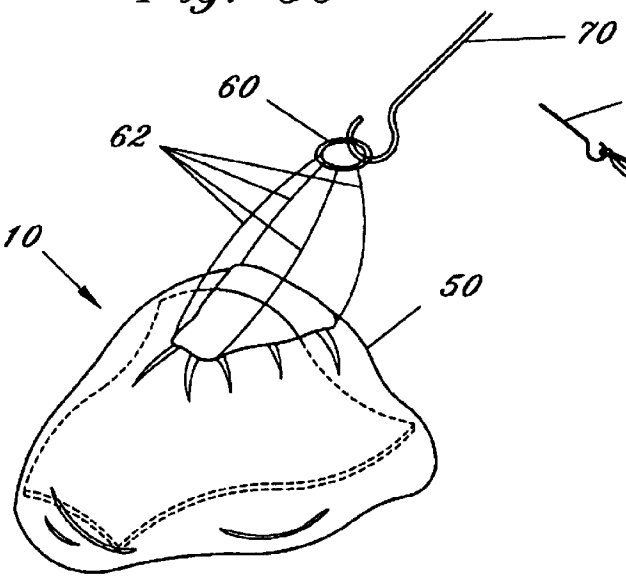
FIG. 5*d* is a top perspective view of the urinal drip pad being enveloped by the disposal container during step two of the removal and disposal process.
Figure 5A:
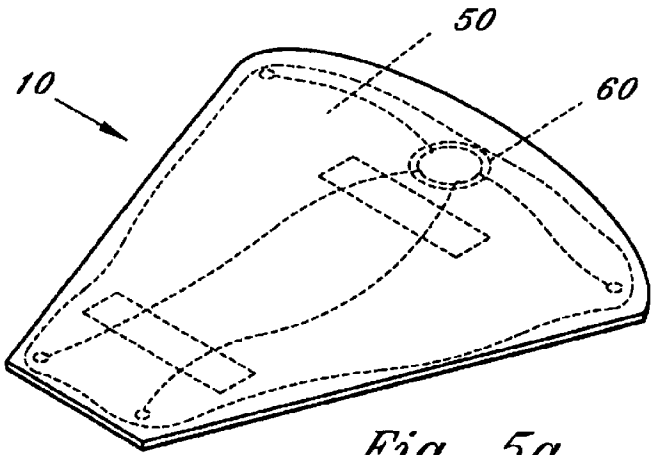
FIG. 5*a* is a top perspective view of the urinal drip pad with the disposal container assembly.
Figure 5B:
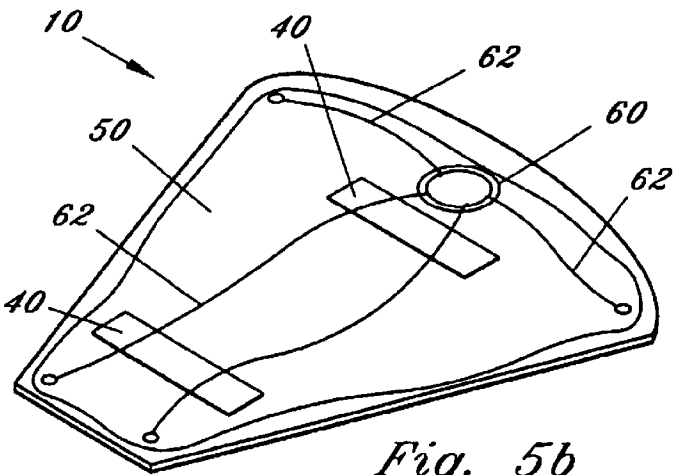
FIG. 5*b* is a bottom perspective view of the urinal drip pad with the disposal container assembly.

A pad removal tool 70 facilitates removal of the pad. Tool 70 has a suitable tip configuration, such as a hook, for engaging the ring-like removal member 60, whereby lifting of the removal member functions to deploy the thin plastic container thereby enveloping the fluid containing pad in a container suitable for disposal in a disposal container. Thus, the pad may be lifted from its installed position on the floor and disposed of in a sanitary manner without requiring maintenance personnel to come in direct contact with the pad. As depicted in FIG. 5*c* a pad removal tool 70 is inserted beneath an installed pad 10 and engages removal member 60. Next, a force is exerted on the removal member 60 thereby displacing the removal member from its normally concealed position beneath pad 10, and the resulting tension on cords 62 cause the deployment of disposal container 50 thereby enveloping pad 10 as best seen in FIG. 5*d*. Finally, as seen in FIG. 5*e*, pad 10 may be disposed of in a suitable receptacle. While a ring-like removal member 60 and cords 62 are disclosed in the preferred embodiment, an alternate embodiment, without removal member 60 is contemplated. In the alternate embodiment, cords 62 are interconnected such that a removal tool 70, or any other suitable grasping member, may be used to engage one or more cords to deploy disposal container 50 and remove the pad. A further alternate embodiment is contemplated wherein both the removal member 60 and cords 62 are eliminated. In this alternate embodiment removal tool 70, or any other suitable gasping member, may be used to engage and deploy disposal container 50 while removing the pad.

Figure 6:
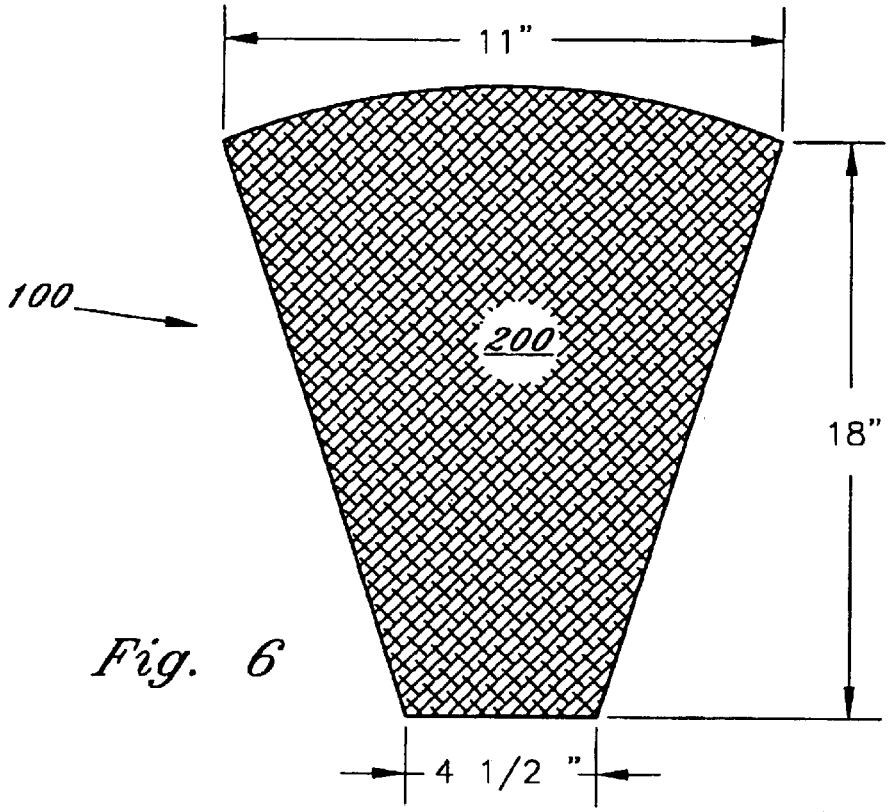
FIG. 6 is a top plan view of an alternately dimensioned urinal drip pad according to the present invention, including approximate dimensions of a preferred embodiment thereof.
Figure 7:
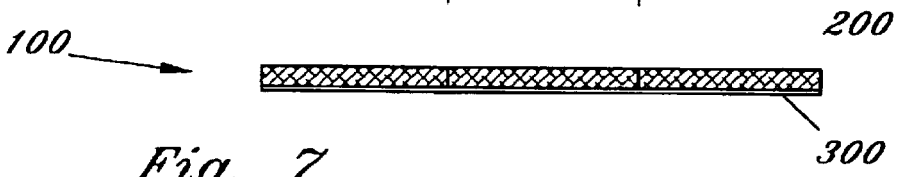
FIG. 7 is a side elevational view of the urinal drip pad depicted in FIG. 6.
Figure 8:
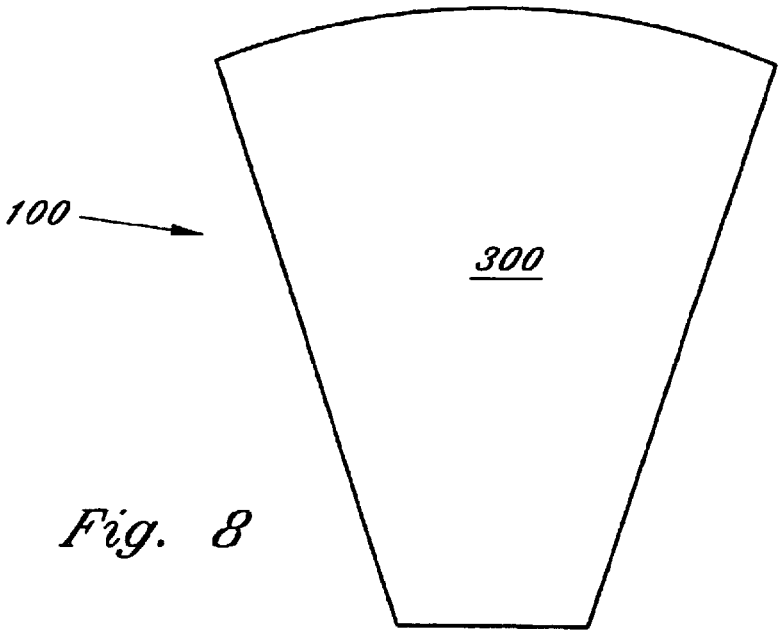
FIG. 8 is a bottom plan view of the urinal drip pad of FIGS. 6 and 7.

FIGS. 6–8 show an alternate embodiment of a urinal pad according to the present invention, generally referenced as 100. Pad 100 includes a first layer of fluid absorbing material 200 and second, backing layer comprising a non-slip, water impervious material 300. The first layer 200 comprises a fluid absorbing material, such as non-woven polypropylene material having a density of approximately 8 to 12 ounces per square yard. The second layer comprises fluid impervious material 300, such as polyester, plastic, PVC, rubber or the like, having a thickness of approximately 0.57 mils. The second layer of fluid impervious material 300 prevents fluids from penetrating through the pad and reaching the underlying floor, and includes a back surface having inherent adhesive and/or non-slip characteristics for securing the pad to the floor and for preventing the pad from slipping. Accordingly, the embodiment depicted in FIGS. 6–8 does not show individual adhesive strips for securing pad 100 to the underlying floor, however, in a preferred embodiment the use of adhesive is considered desirable. Furthermore, although not specifically shown in FIGS. 6–8, it should be readily apparent that pad 100 may also incorporate a deployable disposal container referenced as 50 and shown in FIGS. 5*a*–*e*.

Figure 9:
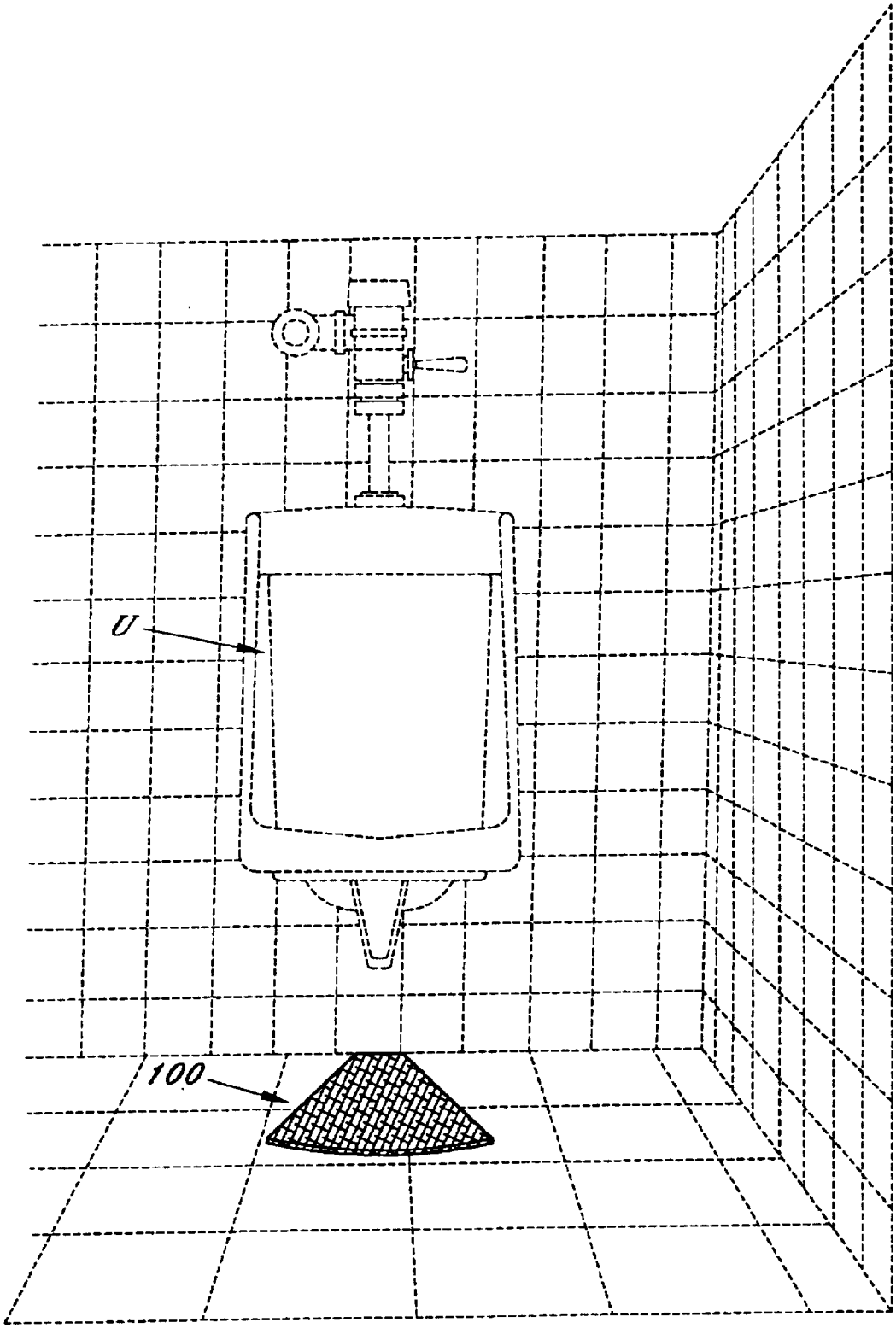
FIG. 9 is a perspective view of the urinal drip pad installed in front of a urinal.

The embodiment depicted in FIGS. 6–9 is suitably sized for use with a conventional urinal. Pad 100 has a first edge 102 and an opposing second edge 104. Pad 100 defines a first edge length of approximately 4½ inches, a second edge length of approximately 11-inches and a length separating the edges of approximately 18-inches. Specifically, as best depicted in FIG. 9, first edge 102 is generally linear for intended placement in abutting adjacent relation with the lower edge of the wall upon which the urinal is mounted. The proper installation of pad 100 is facilitated by placing first edge 102 substantially adjacent to and/or in abutting engagement with the wall upon which the urinal "U" is mounted. When properly positioned, the pad is specifically sized to extend below and in front of the urinal so as to cover the floor area where most fluids, which for one reason or another, are not received within the confines of the urinal will land. In addition, pad 100 preferably has a length of approximately 18-inches such that drip pad 100 extends longitudinally in a direction normal to the wall. When properly positioned, pad 100 covers a portion of the floor directly beneath and in front of the urinal such that the vast majority of fluid that is not deposited in the urinal will, in all probability, fall onto first layer wherein the fluid will be absorbed and prevented from reaching the floor. In addition, the shape and placement of drip pad 100 results in the pad remaining unobtrusively disposed between the feet of a urinal user and optimally positioned so as to cover the floor area where fluid, such as urine and water, which, for various reasons, is not received within the urinal and is most likely to land.

As discussed briefly hereinabove, any embodiment of the present invention, may further be chemically treated with an anti-microbial agent which effectively maintains the pad biologically sanitary. Furthermore, any embodiment of the present invention may also be chemically treated with a fragrance agent for providing a pleasing scent.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A disposable and inexpensive floor mounted pad for placement on a floor surface, directly in front of a wall mounted urinal for absorbing fluid not deposited within the confinements of the urinal which would otherwise drip on the floor, said pad comprising:

a pad body, including:

a first layer of fluid absorbing material;

a second layer of fluid impervious material bonded to said first layer of fluid absorbing material, said second layer constructed of a non-slip fluid impervious material; and a quantity of adhesive material attached to said second layer opposite said first layer, whereby said pad body may be adhesively secured to the floor in front of a urinal;

said pad body being constructed in a substantially flat truncated annular sector resembling a truncated pie slice.

2. The floor mounted pad of claim 1, further comprising an anti-microbial agent permeating the pad.

3. A disposable floor mounted pad according to claim 1, wherein said first layer is chemically treated with an anti-microbial agent, and said pad includes:

a first straight edge approximately four inches in length, a second curved edge approximately eleven inches, and two sides forming the radial pie shape of approximately eighteen inches each in length.

4. A disposable floor mounted pad according to claim 3, wherein said first layer is chemically treated with a fragrance agent.

* * * * *